US009139952B2

(12) United States Patent
Hangley

(10) Patent No.: US 9,139,952 B2
(45) Date of Patent: Sep. 22, 2015

(54) APPLICATOR FOR APPLYING RESIN TO A PRECREASED PIECE OF FABRIC AND METHOD OF THE SAME

(76) Inventor: James Hangley, Long Beach, NY (US)

( * ) Notice: Subject to any disclaimer, the term of this patent is extended or adjusted under 35 U.S.C. 154(b) by 308 days.

(21) Appl. No.: 13/385,824

(22) Filed: Mar. 8, 2012

(65) Prior Publication Data

US 2013/0236640 A1 Sep. 12, 2013

(51) Int. Cl.

| | |
|---|---|
| ***B05C 5/02*** | (2006.01) |
| ***B05D 5/10*** | (2006.01) |
| ***A41D 1/10*** | (2006.01) |
| ***D06J 1/00*** | (2006.01) |
| *B05C 17/015* | (2006.01) |
| *A41B 5/00* | (2006.01) |

(52) U.S. Cl.
CPC ... *D06J 1/00* (2013.01); *A41D 1/10* (2013.01); *B05C 5/02* (2013.01); *A41B 5/00* (2013.01); *B05C 17/015* (2013.01)

(58) Field of Classification Search
None
See application file for complete search history.

(56) References Cited

U.S. PATENT DOCUMENTS

| | | | | |
|---|---|---|---|---|
| 3,853,410 | A * | 12/1974 | Busoni | 401/1 |
| 4,756,170 | A * | 7/1988 | Gibson et al. | 68/200 |
| 4,778,299 | A * | 10/1988 | Coulter | 401/48 |
| 6,422,777 | B1 | 7/2002 | Landrau | 68/200 |
| 6,722,537 | B1 | 4/2004 | Houlbrook | 222/611.1 |
| 2004/0169053 | A1 * | 9/2004 | Liljeqvist | 222/611.1 |
| 2005/0051571 | A1 | 3/2005 | Carruth | 222/1 |
| 2009/0043282 | A1 * | 2/2009 | Hughes et al. | 604/518 |
| 2011/0027753 | A1 | 2/2011 | Maurat | 433/141 |
| 2011/0091590 | A1 | 4/2011 | McMahon | 425/87 |

* cited by examiner

*Primary Examiner* — Dah-Wei D Yuan
*Assistant Examiner* — Jethro M Pence
(74) *Attorney, Agent, or Firm* — Richard B Klar, Esq.; Law Office of Richard B. Klar

(57) ABSTRACT

An improved applicator for applying resin adhesive to a crease in fabric or an article of textile such as clothing in which a nozzle is located at the distal front end of the cartridge and a guide is located behind a receiver head. The receiver head is attached to the rear end of the cartridge.

10 Claims, 3 Drawing Sheets

APPLICATOR FOR APPLYING RESIN TO A PRECREASED PIECE OF FABRIC AND METHOD OF THE SAME

BACKGROUND

1. Field

The present invention relates to an applicator for applying resin adhesive to a crease in fabric or clothing such as trousers or shirts to ensure a permanent crease. In particular, the present invention provides for an improved applicator applying resin adhesive to a crease in fabric or clothing a guide which is located behind a receiver head where the receiver head is attached to the rear end of the cartridge and a threadably attached nozzle located at the distal front end of the cartridge.

2. The Related Prior Art

U.S. Pat. No. 6,722,537 discloses a cartridge for dispensing fluent materials into creases of garments where the cartridge includes a plastic elongated body having an integral tongue projecting laterally of the body at one end and through which the fluent composition (40) is dispensed by passing a piston (32) along the inside of the body. The tongue is a narrow member and is aligned with integral laterally projecting fins (18, 20) which fit into the crease of a garment to be rendered permanent. The tongue has a narrow rectangular bore into which fits a nozzle also having a narrow rectangular bore. The tongue bore and the nozzle bore are aligned with the fins so as to provide maximum exactness in alignment of the body, crease and ribbon of composition which is dispensed from the nozzle.

U.S. Pat. No. 6,422,777 shows an applicator gun for resins for crack repair; Spatula 24 (e.g., an aluminum blade) extends from the top end 26 of nozzle 14 and functions to spread the protective coating once it is urged through the end opening of nozzle 14 by the action of plunger 28, U.S. Pat. No. 4,756,170 discloses a crease-setting composition which comprises an applicator body having at one end thereof a nozzle; air is compressed by a compressor 7 and sent through a filter and regulator 8, to bear against a piston 10 in the applicator 4; the composition in the cylinder is acted on by the piston and forced through the nozzle 5. A fin-like guide plate 11 is mounted on the lower surface of the applicator body 4. The width 12 of the plate 11 at its lower edge corresponds to the crease to be set in the fabric.

SUMMARY

The present invention relates to an improved applicator for applying resin to a crease in clothing. The improved applicator includes a piston driven cartridge filled with resin/adhesive preferably silicon and has a guide located behind a receiver head that is attached, preferably clipped onto the rear end of the cartridge 5. The applicant is the inventor of two earlier patents U.S. Pat. No. 5,211,755 granted May 18, 1993 and U.S. Pat. No. 6,363,634 granted Apr. 2, 2002 and incorporates the subject matter thereof by reference thereto as if included herein.

The present invention further includes the receiver head connected to a hose to provide pneumatic pressure to push along the piston in the cartridge to dispense the resin out of the front distal end of the tube so that an operator can provide adequate pressure on the front distal end when the nozzle is attached on the cartridge to ensure that the resin is firmly applied within the creases of the garment.

In addition, the guide provides for a small, inexpensive piece of equipment for providing an efficient and cost effective technique solution for guiding the resin in the creases of garments.

Still another object of the present invention is to provide a threadably connectable nozzle to the distal front end of the cartridge where the nozzle has a flat dispensing end for the dispensing resin in the crease. The flat shape of the nozzle is smaller than the dispenser of the cartridge in order to achieve a better fluid flow when a fluid/resin is dispensed.

It is still another object of the invention to provide an o-ring between the joinder of the cartridge and nozzle to prevent resin from escaping and air from entering.

Other objects of the present invention will become apparent from the foregoing description and accompanying drawings.

DETAILED DESCRIPTION OF THE PREFERRED EMBODIMENT(S)

Figure 1:
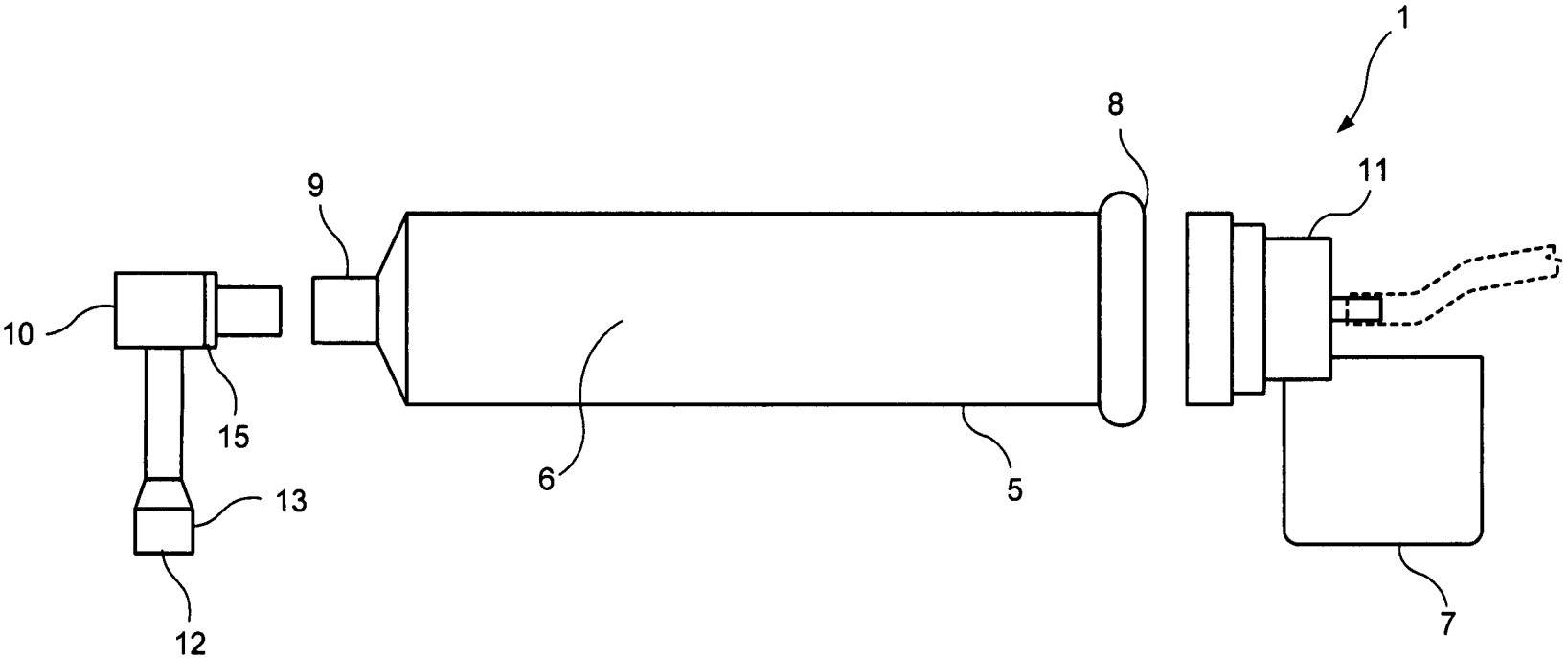
FIG. 1 illustrates the present invention.
Figure 2:
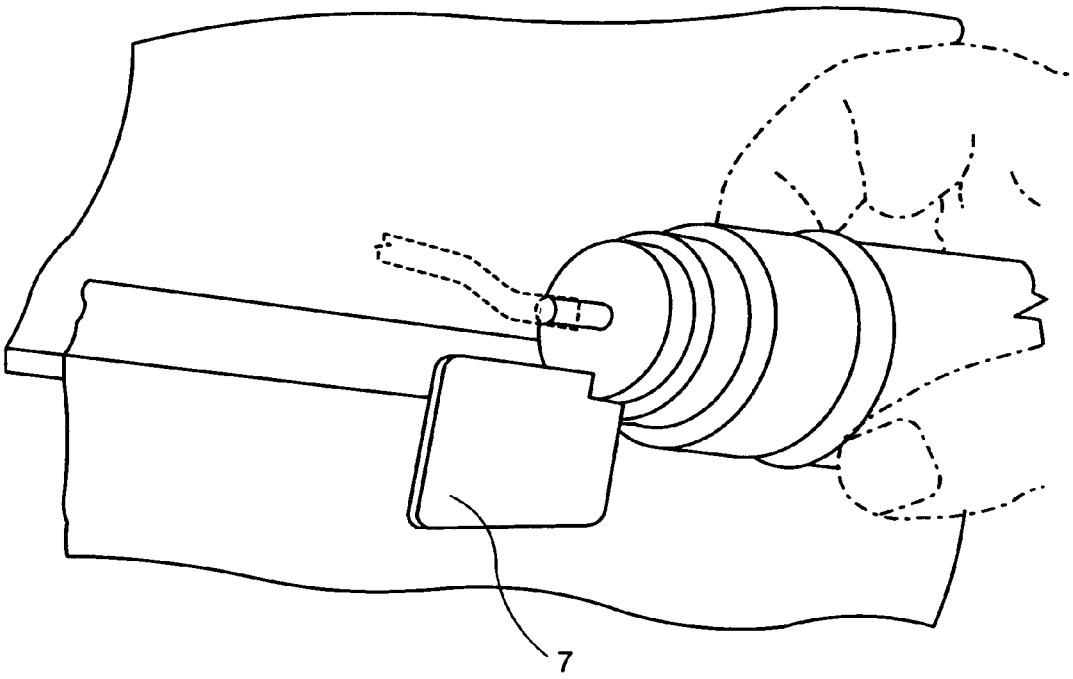
FIG. 2 shows the guide of the present invention.
Figure 3:
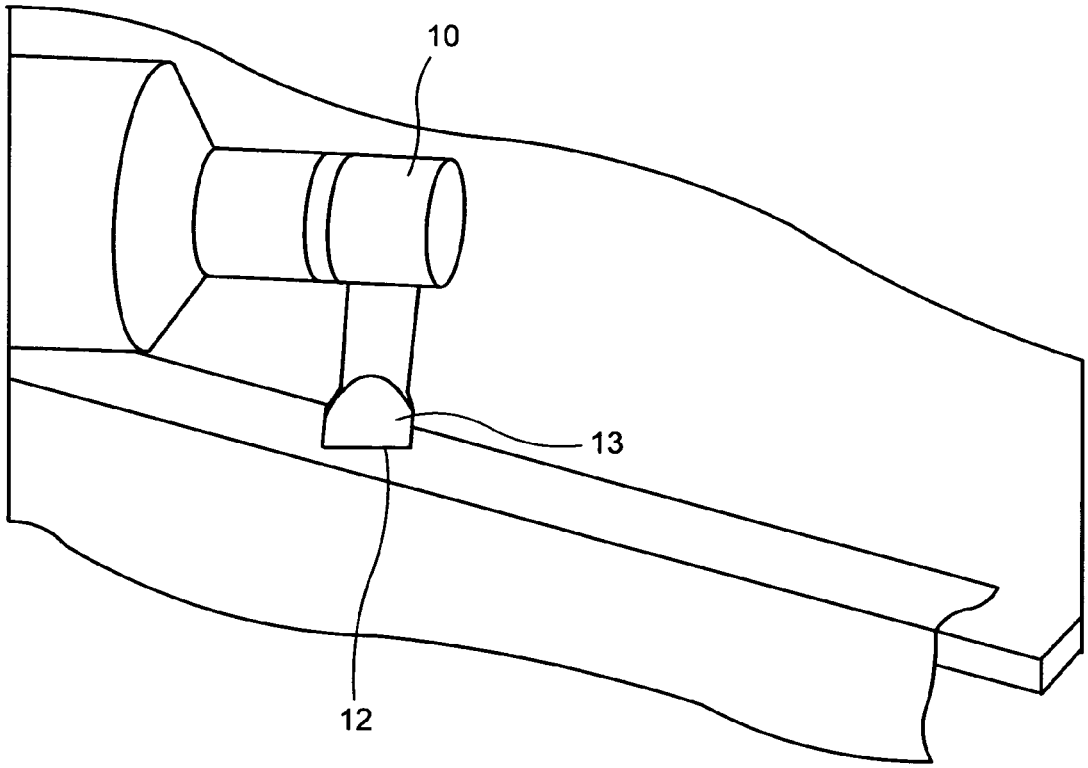
FIG. 3 shows the nozzle of the present invention.

Referring now to the drawings of FIGS. 1-3 of the present invention is directed toward an applicator 1 for applying resin adhesive to a crease in fabric or clothing such as shirts, trouser creases, pleats, etc. to ensure permanent creasing as shown in FIG. 1. The applicator is used in connection with a system such as described in U.S. Pat. Nos. 5,211,755 and 6,363,634, noted previously.

The present invention shown in FIG. 1 discloses a garment is laid upon a stand or table and a piston driven applicator cartridge 5 with resin/adhesive 6 silicon therein applies resin to the crease along the longitudinal level of the crease of the garment. The applicator 1 has a guide 7 that is moved within a groove to ensure that the resin 6 is distributed and applied accurately in the crease.

FIG. 1 shows an improved applicator 5 of the present invention in which a piston driven cartridge has a rearward end 8 and a front distal end 9. A nozzle 10 is connected to the front distal end 9 and is removably and preferably threadably connected to the cartridge 5. The cartridge 5 is filled with an adhesive resin 6 such as silicon resin. The cartridge 5 has a rearward end 8 to which is connected a receiver head 11 that connects a hose (not shown) to supply pneumatic pressure for driving the piston in the cartridge 5 moving the resin 6 forward toward the distal front end 9 into the nozzle 10.

Behind the receiver head 11 is removably connected a guide 7 that can be seated in a crease of a textile article such as an article of clothing so that it guides the applicator 1 along the longitudinal length of the crease as the adhesive resin 6 is supplied from the slit 12 in the flat end 13 of the nozzle 10. The guide 7 moves within the crease to ensure that the resin 6 is distributed and applied accurately in the crease. Having the guide 7 located behind the cartridge 5 and the receiver head 11 makes it easier to guide the applicator 1 while maintaining the necessary pressure for the nozzle 10 to remain firmly in the crease. The applicator 1 moves along within the crease dispensing the resin 6. The guide can be reused with different cartridges 5 and can be firmly attached to the receiver head 11 with a screw or by other known connecting mechanisms. The guide (FIG. 2) is a small inexpensive piece of equipment that provides for an efficient and cost effective technique and solution for guiding resin in the creases of garments.

At the distal front end 9 of the tube 5 is a preferably threadably connectable nozzle 10 which connects to the threads of the cartridge 5. The nozzle 10 has a flat dispensing end 13 with a slit 12 through which is dispensed resin 6 into the crease. The flat dispensing end 13 has a flat shape to better align itself with the crease (see FIG. 3). The flat end 13 has a slit 12 which is smaller than the opening of the cartridge 5 where the nozzle 10 joins the cartridge 5. After removing the lure from the end of the cartridge 5 better fluid flow is achieved by having an opening that is smaller where fluid/resin 6 is dispensed than from where it enters the nozzle 10. An 0-ring 15 is preferably provided between the joinder of the cartridge 5 and the nozzle 10 to prevent resin from escaping and air from entering (FIG. 1).

While presently preferred embodiments have been described for purposes of the disclosure, numerous changes in the arrangement of method steps and apparatus parts can be made by those skilled in the art. Such changes are encompassed within the spirit of the invention as defined by the appended claims.

What is claimed:

1. A device including an applicator for applying an adhesive resin to creases in a fabric or textile article such as clothing, comprising:

a piston driven cartridge filled with an adhesive resin, said cartridge having a rearward end and a front distal end;

a removable nozzle connected to said front distal end of said cartridge configured to dispense resin from said cartridge;

a receiver head located behind a rearward end of said cartridge and is adapted to connect a hose to said cartridge to provide pneumatic pressure to drive said piston forward toward said front distal end to dispense said resin through said nozzle; and said device including a removable guide connected behind said receiver head and is located only partially underneath and having a portion extending vertically to a same height as said cartridge level and extending in a first direction and extending at least partially beyond said applicator in a second direction configured to guide said applicator along a crease in said fabric or textile article to provide guidance of said applicator along said crease of the garment and said guide having a top portion extending vertically above a same height of said cartridge level and said top portion being stationarily affixed in a vertical direction to said receiver head and said guide being dependent of movement of said receiver head in a vertical direction.

2. The device according to claim 1 wherein said guide is removably connected to said receiver head.

3. The device according to claim 1 wherein said nozzle has a flat edge and has a slit in order to dispense resin from said cartridge.

4. The device according to claim 1 wherein the nozzle is threadably connected at the distal front end of the cartridge to threads of the cartridge.

5. The device according to claim 1 wherein the nozzle has a flat dispensing end for dispensing resin in the crease and has a flat shape to better align itself with the crease.

6. The device according to claim 5 wherein the flat end is smaller than the opening of the cartridge where the nozzle joins the cartridge so that better fluid flow is achieved by having an opening that is smaller where fluid/resin is dispensed than from where it enters the nozzle.

7. The device according to claim 6 wherein said cartridge has a lure that is removed from said cartridge and said nozzle is joined at this location to said cartridge to dispense the resin from said cartridge.

8. The device according to claim 1 wherein an 0-ring is located between the joinder of the cartridge and the nozzle to prevent air entering and resin from escaping.

9. The device according to claim 1 wherein said receiver head is removably connected to said cartridge.

10. The device according to claim 1 wherein said guide has a thin flat edge that sits within and moves firmly along a crease as resin is dispensed from the applicator.

* * * * *